United States Patent [19]

Helin

[11] Patent Number: 4,832,965

[45] Date of Patent: May 23, 1989

[54] METHOD OF MAKING A BOTTLE AND PACKAGING A WATER RATION THEREIN

[76] Inventor: Stig-Aake Helin, P.O. Box 52055, S-40025 Goeteborg, Sweden

[21] Appl. No.: 6,498

[22] PCT Filed: May 16, 1986

[86] PCT No.: PCT/EP86/00298

§ 371 Date: Jan. 16, 1987

§ 102(e) Date: Jan. 16, 1987

[87] PCT Pub. No.: WO86/06700

PCT Pub. Date: Nov. 20, 1986

[30] Foreign Application Priority Data

May 17, 1985 [DE] Fed. Rep. of Germany ... 8514691[U]
Dec. 19, 1985 [DE] Fed. Rep. of Germany ..... 3545116

[51] Int. Cl.[4] ..... B65B 3/02; B65B 55/02

[52] U.S. Cl. ..... 426/66; 426/396; 426/407; 53/425; 53/440; 215/1 C

[58] Field of Search ..... 215/1 C, 12 R, 329, 215/328, 246, DIG. 6, 10, 365, 320, 232; 210/900; 426/399, 407, 412, 401, 66, 396; 206/503, 507; D9/367, 375, 389; 53/425, 440, 452, 489, 490; 264/523

[56] References Cited

U.S. PATENT DOCUMENTS

| | | | |
|---|---|---|---|
| D. 213,766 | 4/1969 | Weckman | D9/375 |
| D. 241,915 | 10/1976 | Campbell et al. | D9/375 |
| D. 282,633 | 2/1986 | Beaver et al. | D9/375 |
| D. 289,376 | 4/1987 | Nemits | D9/375 |
| 3,125,237 | 3/1964 | Kitterman | 215/329 |
| 3,142,402 | 7/1964 | Fox | 215/329 X |
| 3,231,394 | 1/1966 | Corrie | 426/407 X |
| 3,233,384 | 2/1966 | Barton et al. | 53/425 X |
| 3,384,226 | 5/1968 | Crisci | 383/38 X |
| 4,015,401 | 4/1977 | St. Amand et al. | 53/425 |
| 4,046,275 | 9/1977 | Virog, Jr. et al. | 215/1 C |
| 4,051,265 | 9/1977 | Kirshenbaum et al. | 215/12 R X |
| 4,070,289 | 1/1978 | Akcasu | 210/900 X |
| 4,177,905 | 12/1979 | Winchell et al. | 215/246 |
| 4,239,082 | 12/1980 | Irving | 215/1 C X |
| 4,416,373 | 11/1983 | Delarosiere | 215/1 C X |
| 4,569,869 | 2/1986 | Kushida et al. | 215/1 C X |
| 4,573,595 | 3/1986 | Mednis | 215/1 C X |
| 4,579,260 | 4/1986 | Young et al. | 215/1 C X |
| 4,592,884 | 6/1986 | Thompson | 215/1 C X |
| 4,622,800 | 11/1986 | Turtschan | 53/425 |
| 4,642,968 | 2/1987 | McHenry et al. | 53/425 |
| 4,667,454 | 5/1987 | McHenry et al. | 53/425 |

FOREIGN PATENT DOCUMENTS

| | | | |
|---|---|---|---|
| 943506 | 3/1974 | Canada | 215/365 |
| 183968 | 6/1986 | European Pat. Off. | 210/900 |
| 2843784 | 4/1980 | Fed. Rep. of Germany | 53/425 |
| 60882 | 1/1985 | Japan | 210/900 |
| 208140 | 9/1924 | United Kingdom | 426/407 |
| 929346 | 6/1963 | United Kingdom | 426/407 |
| 1437321 | 5/1976 | United Kingdom | 215/10 |

*Primary Examiner*—Sue A. Weaver

[57] ABSTRACT

A bottle used for housing an emergency water ration which is made of high density polyethylene. The material of the bottle is stabilized with UV light. After filling the bottle with water it is sterilized under high pressure conditions in a water bath at a temperature of 120° C. for at least 10 minutes and cooled by means of compressed air. The body of the bottle has a side ratio equal to 1:0.6:0.4 with all sides containing round edges. The bottom surface has a concave configuration. Such a bottle is completely undeformable and may be dropped into the water without damage from a height of 36 m. The water in the bottle has a lifetime longer than 5 years.

6 Claims, 3 Drawing Sheets

FIG. 2
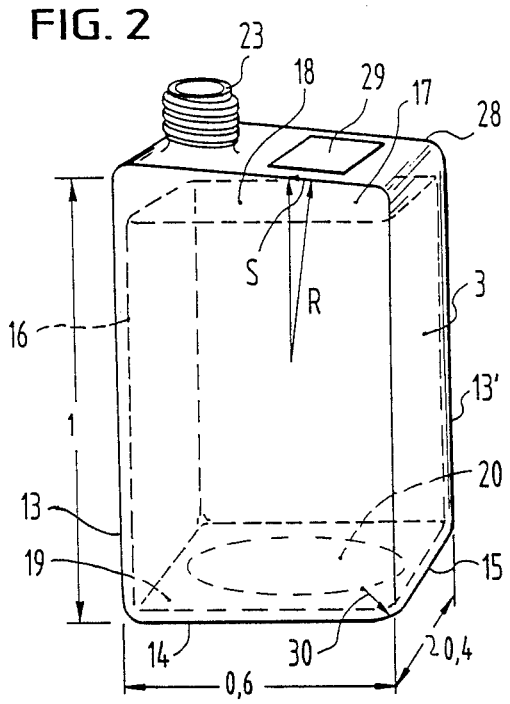
FIG. 3
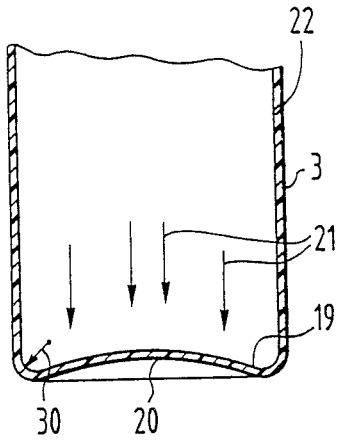
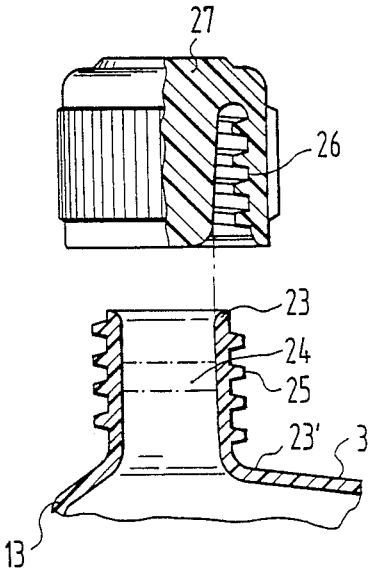
FIG. 4
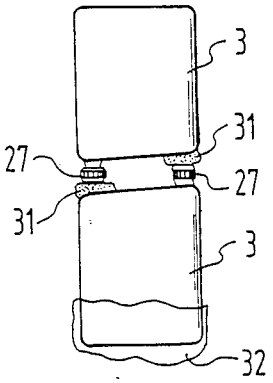
FIG. 5

METHOD OF MAKING A BOTTLE AND PACKAGING A WATER RATION THEREIN

BACKGROUND OF THE INVENTION

The present invention relates to a bottle which provides an emergency water ration and to a method for its manufacture.

A bottle used an emergency water container or as an emergency water ration is thrown into the water in rescue vessels from an airplane or from a ship and used on rafts and in lifeboats. Such a bottle is subject to high requirements. Packed in a rescue vessel, it must e.g. be adapted to be thrown into the water without damage from a height of at least 36 m, and it must further be resistant particularly to crude oil and salt water, and the content drinking water should have a lifetime of up to 5 years.

There are already known quite a lot of containers for water rations for the above purposes. On rafts or the like water rations are used in form of tin cans, in which the water is sterilized, and the cans are locked after disinfection. The drawback of such containers resides in that due to the influence of sea water the containers are readily subjected to corrosion, so that after a short time they become useless. Another disadvantage resides in that when they are subjected to mechanical action, for example when they are mechanically bumped, their double flanges or soldered seams or joints break open which results in a loss of the water. Also cylindrically shaped cans occupy a relatively large space, which is particularly disadvantageous in rescue vessels which are thrown into the water. However, to avoid such disadvantages, so-called "plastic packs" sometimes have been used. These are small bags made of a foil tube by first filling the tubular body with water and then welding and dividing it into predetermined compartments. Such water-containing and plastic-made packets have a content of about 100 ml. The material used for the tube is preferably polypropylene, and the filled packets are sterilized by exposing them to UV radiation. For sterilizing the water serving as the emergency ration it is also known in the art to use silver nitrate. However, such a disinfectant is often disapproved of, and in some countries only boiled water as an emergency ration is licensed to be used. Such small plastic-made packs which contain a relatively small amount of water have the disadvantage that they are not sufficiently resistant to mechanical influences such as occur when the pack is thrown down from a height of at least 36 m. Usually the packs burst whereby the water flows out.

It is therefore the object of the present invention to provide a bottle useful as an emergency water ration which when packed in a rescue vessel, is resistant to deformations and may be packed in a relatively high packing density. It is another object of the present invention to provide a method of making such a bottle containing boiled, sterilized water.

Thanks to its material and its particular shape the bottle used for housing the emergency water ration according to the present invention is inherently very stable. The highy density polyethylene is particularly suitable for the intended purpose. Aside from a comparatively highy compression and tensile strengths, polyethylene has an excellent stability within the range of atmospheric temperatures. Due to the fact that the bottle is made as a flat body and has an inclined front face including the pouring spout, it is possible to pack a plurality of bottles in a narrow space. The vaulted lower bottom and the arrangement of the feeder, which is displaced to one side of the upper bottom, serves to dampen the energy shock when the bottle hits the water surface after being disposed from a significant height and also prevents the neck of the bottle from being struck. The location of the feeder or pouring spout at one side of the bottle also serves for better handling of the bottle when drinking, so that e.g. in the case of heavy seas, no drinking water is spilled.

Another significant advantage is that the bottle has a locking plug which is also made of high density polyethylene and which has a conically shaped plug for engaging with the neck of the bottle and with a thread engaging in the thread of the pouring spout. Due to the inside cone of the locking plug the neck of the bottle is slightly expanded as the bottle is being locked, thus being securely sealed in that the thread is self-locking in this condition.

According to the present invention it is further proposed that both the locking plug and the pouring spout have a buttress thread. Such a particular thread had the advantage that after completed sterilization the screw cap cannot be blocked in such a way that the opening of the bottle is rendered undesirably difficult.

According to another proposal of the present invention both the locking plug and the pouring spout have a trapezoidal thread.

Another significant advantage is that the pouring spout has a flange, disposed below the thread. In the locked condition the lower ring surface of the locking plug is thereby slightly spaced from the upper ring surface of the flange. Such a design allows a shrink sealing of the screw cap of the bottle, for which purpose a shrink foil is applied to the locking plug and the flange, or the gap between the locking plug and the flange is sealed by a colored varnish.

Another significant advantage of the present invention is that the polyethylene is maintained free or organic dyes or the like. Thus, it is ensured that the material of the bottle does not secrete any substances which affect the taste of the water.

According to the present invention it is further proposed that in a lateral wall of the bottle there is arranged a transparent sight strip extending in the longitudinal direction of the bottle. Such a sight strip, which is preferably arranged in a narrow side, enables the filling level to be exactly read, while the filling level is not readily readable across the remaining portions of the walls which are not necessarily transparent. In order to provide exact reading the sight strip may be provided with an appropriate scale.

The radii of the of the inside edges of the bottle are rounded with a size of at least 5 mm, so that punctual loads, such as may occur when the bottle is disposed from a large height, can be avoided. Also the pouring spout is arranged on the inclined surface with radial transitions whereby the bottle also receives the required stability in this critical area.

According to another feature of the present invention, on one of the lateral walls of the bottle there is provided a text field with information given in friction-resistant raised letters. The raised letters may be pressed or milled in the lateral wall and comprises, inter alia, information on licenses and rules of respective countries for the water quality of the emergency water ration.

Despite the face that hollow products made of polyethylene of the above kind exhibit a high expandibility, the volume of the bottle is not completely filled with water. According to the present invention it is therefore proposed that only about 95% of the volume of the bottle be utilized. Thanks to the advantageous shape of the bottle the volume required for packing a filled bottle is only 20 to 25% larger than the bottle volume, to that the space available in a rescue vessel is very well utilized. The hitherto used water containers require more packing space for a comparable amount of drinking water.

The bottle is resistant to petroleum and to temperatures ranging from −35° C. to 125° C. so that the sterilization process may be carried out without damage to the bottle and the latter is ready for use under the most varied climatic conditions.

According to the present invention it is proposed that for preparing the bottle there is used a high density polyethylene free of organic dyes; that in the finished state of the polyethylene bottle is stabilized with UV light and that the bottle is then filled with water, locked and sterilized. It is an essential point that the polyethylene which is free of organic dyes or the like does not secrete any substances which affect the taste and quality of the water. For this reason the material of the finished bottle is once again sterilized with UV light to prevent traces of the materials contained in the polyethylene from passing into the drinking water.

The sterilization of the drinking water in the finished bottle is performed in a manner such that after the bottle is filled with filtered drinking water and locked, it is placed in an overpressure water bath heated to 120° C. The duration of the heating is not critical, however, it should be at least 10 minutes. For sterilizing the water in the bottle the high inherent stability of the stabilized polyethylene of the above kind is particularly useful. As mentioned above, prior to sterilization the material of the bottle is stabilized so as to prevent taste-affecting components from passing from the material of the bottle into the drinking water. After cooling the bottle, which is done preferably by using compressed air, the bottles are marked, whereby particularly the date of filling and the date of ultimate consumption are placed beside the pouring spout of the bottle.

Due to the fact that the locking cap consists of the same material as the bottle, taste-affecting substances are prevented from passing from the locking plug into the drinking water. Further, the locking plug does not require any special sealing which would have to be highly resistant. It goes without saying that also the material of the plug will be stabilized with UV radiation after completion thereof.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a perspective view of this water container of the present invention;

FIG. 3 is a cross-section through the bottom of the bottle of FIG. 2;

FIG. 4 shows the pouring spout of the bottle with the locking plug, partially in section;

FIG. 5 is a diagram showing the storing of the bottle of FIG. 2;

DETAILED DESCRIPTION OF THE INVENTION

Figure 1:
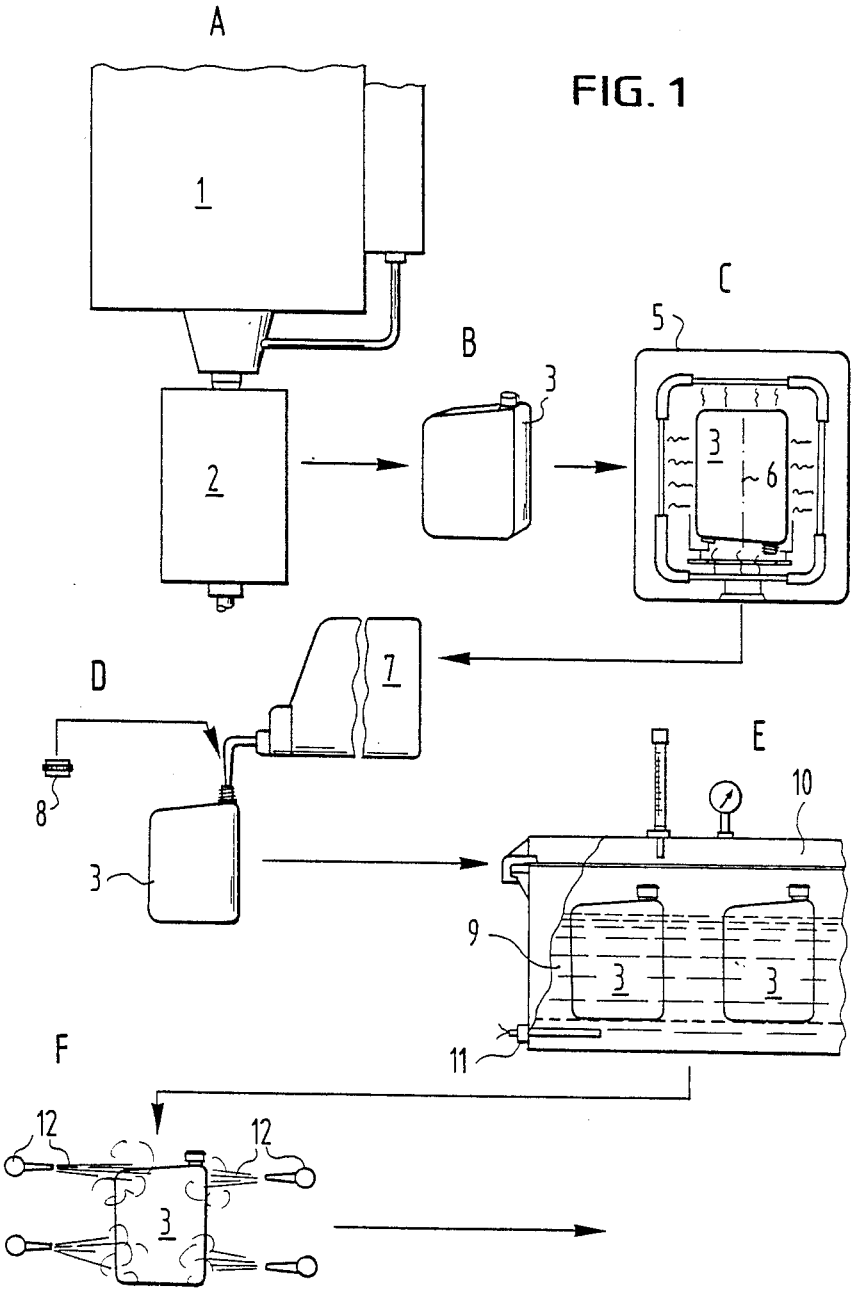
FIGS. 1A to F shows various process steps for manufacturing the emergency water container and contents of the represent invention.

According to FIG. 1, indicated at A the high density polyethylene in the form of granulated material is molten and then forced by means of the die-casting and blowing machine 1 having a ring nozzle into a multipart mold 2. After cooling down of the mold, as shown at B, the shaped part, in the present case the bottle 3 serving for receiving the emergency water ration, is removed from the mold. In station C the material of the bottle is stabilized with UV rays. This is the purpose of the chamber 5, through which the bottles are led successively, and in this process step it is advantageous to rotate the bottles about their axial center 6 to evenly expose all of the surfaces to the UV light. In the next station D water is led into the bottle 3 from a tank 7 containing purified drinking water, whereupn the bottle is locked with a plug 8. This is followed by the disinfection or sterilization of the drinking water, as shown at E. The bottles 3 are placed into a water bath 9 which is then locked with the cover 10 and, as shown at 11, heated under pressure to 120° C. This temperature must be maintained for at least 10 minutes, however, no longer than 20 minutes. This is to ensure that all virulent germs and algae in the drinking water and throughout the bottle are killed. This process should take no longer than 20 minutes, because otherwise is may happen that the continued load causes permanent deformations in the polyethylene containers. As shown at F, the finished bottles are now cooled with compressed air blasts 12, then surrounded by thin plastic foils and finally stored for shipment.

As can be seen from FIG. 2, the bottle-shaped container 3 is made as a flat body having an edge ratio of the vertical edge 13, 13' to the bottom edge 14 and to the depth edge 15 equal to 1:0.6:0.4. The vertical edge 13 is somewhat longer than the edge 13', the vertical edge being defined by the mean value. The inside space 17 of the bottle 3 is 5% larger than the water volume 16 of the bottle. In this way, a hollow space 18 is produced over the water volume of the bottle, which serves as an air cushion when the bottle is disposed down and strikes e.g. the surface of the sea.

As to be seen also from FIG. 3, the bottom 19 of the bottle has an inwardly vaulted chamber 20 which serves to bias out due to defomration caused by a heavy impact against the water or from some other source, e.g. in the direction of the arrows 21. The wall thickness of the wall 22 is from 1 to 1.5 mm, depending on the respective volume, and it is 1 mm for a bottle containing 500 ml.

As to be seen particularly from FIG. 4, the connection 23' of the pouring spout 23 is well-rounded, so that in this critical area, punctual loads may be avoided. The pouring spout is disposed close to the region of the long edge 13 and has a trapezoidal thread 25, into which the thread 26 of the locking plug 27 may engage. As shown in dotted lines, such cone abuts against the pouring spout approximately in the area 24. This has the consequence that by further screwing the plug, the neck of the pouring spout is slightly expanded and the threads 25, 26 thus become self-locking.

On the somewhat inclined front face 28 of the bottle according to FIG. 2 there is arranged a marker 29 to indicate the filling date and the date of ultimate consumption of the contents of the bottle content. The inclined front face has the advantage that it facilitates the handling of the bottle when drinking, but it also allows a higher packing density for packing a plurality of bottles in a rescue vessel.

As shown in FIG. 5, the bottles 3 are stacked with their locking plugs 27 facing each other when the bottles are used to equip a rescue vessel, a pneumatic boat, a raft or the like. Proceeding in this way allows a higher pile density. It should be noted that for the design of the bottle, it is the combination of the features of the present invention which is of importance, rather than the details of these features. For example, the filling level of the bottle is in interrelationship with the design of the bottom. Thus, if the bottle is filled with water to the extent that the entire volume of the bottle is used, its bottom will be readily deformed in the case of only slight loads. Thus, the bottle cannot be effective when subjected to shock loads. All the inside radii, corner radii and edge radii 30 are at least 5 mm so that punctual loads in these regions may be avoided. When the manufacture of the bottle-shaped containers 3 have been finished, cooled and provided with filling marks 29, each of them is surrounded with a coating foil 32. When a plurality of bottles 3 are packed against each other, as shown in FIG. 5, a pad 31 may be positioned between each plug and the adjacent bottle to improve the stability of the entire pack.

With respect to FIG. 2 it should be noted that the inclined surface 28 is intended for generating a transversal component S as a response to an impact caused by conact with the water in the direction of the arrow R. This had the consequence that swirls are generated due to the arising transverse flow S of the water in the region of the critical cross-section and of the connection of the plug on the container 3 respectively, said swirls mitigating the impact energy in the critical region.

Figure 8:
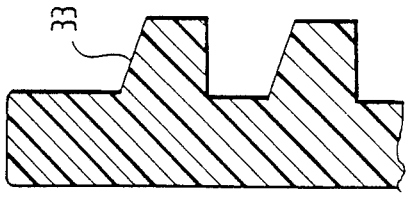
FIG. 8 is a cross-section of the buttress threads of the bottle of FIG. 6.
Figure 7:
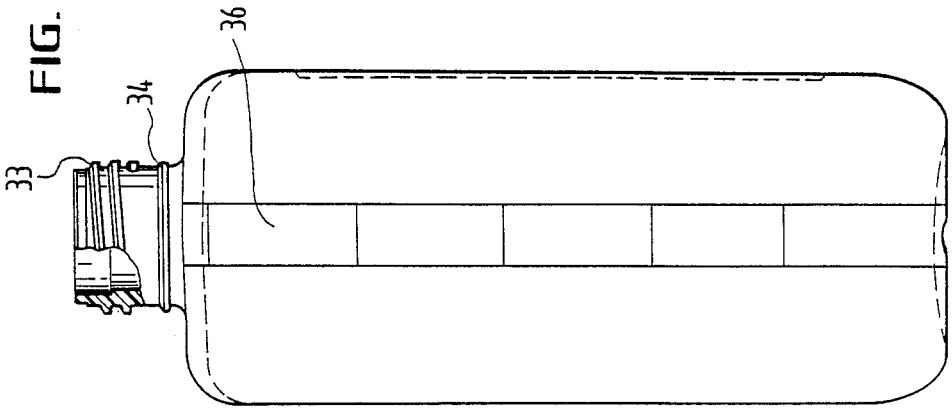
FIG. 7 is a view of the narrow side of the bottle according to FIG. 6.
Figure 6:
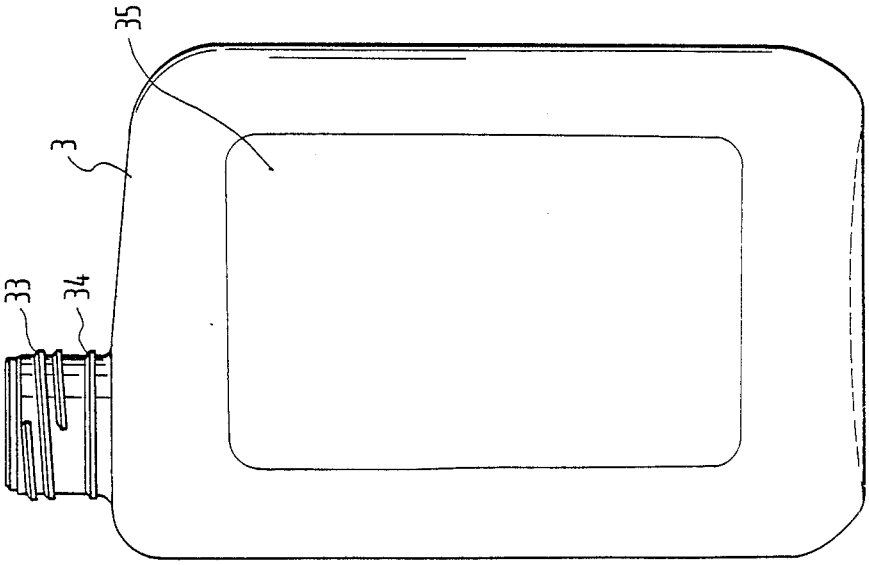
FIG. 6 is a side view of the bottle of the present invention.

FIGS. 6 and 7 show an alternative embodiment of the bottle according to the present invention with its most important dimensions, said bottle being intended for receiving 500 ml of drinking water. In this alternative embodiment the pouring spout has a buttress thread 33 which is shown in an enlarged scale in FIG. 8. The particular arrangement of such buttress thread ensures that after completed sterilization the screw cap cannot develop a clamp fit such that the bottle cannot be opened without applying considerable force.

Below the buttress thread 33 the pouring spout is provided with a flange 34, from which the lower ring surface of the locking plug in the locked condition is slightly spaced. After the bottle 3 had been finished and filled, a shrink sealing (not shown in the drawing) is applied in the region of the flange 34.

On the broadside of the bottle 3 there is provided a text area 35 (FIG. 6), which contains, in raised letters, inter alia approval data for the water filling, which have been issued by the individual countries which come into question. A narrow side of the bottle contains a transparent sight strip 36 which has a scale for reading the level of the water content in the bottle 3.

I claim:

1. A method for making bottles which are used for storing water which comprises molding high density polyethylene into the shape of bottles, cooling the molded bottles, stabilizing the bottles by exposing them to ultraviolet radiation, introducing water into the bottles, sealing the filled bottles of water with a plug, sterilizing the water by placing the bottles in a water bath where they are heated, under pressure to a temperature of 120° C.

cooling the bottles, and encasing the bottles in a plastic foil.

2. The method of claim 1 wherein the moldable high density polyethylene is produced by heating high density granulated polyethylene into a molten state and forcing the molten polyethylene through a die-casting and blowing machine into a bottle mold.

3. The method of claim 1 wherein the molded bottles are rotated when exposed to ultraviolet radiation.

4. The method of claim 1 wherein 95% by volume of the bottle is filled with water, thereby leaving an air cushion within the bottle.

5. The method of claim 1 wherein said heating at 120° C. is for about 10 to 20 minutes.

6. The method of claim 5 wherein said cooling is by compressed air blown across the bottles.

* * * * *